US009752277B2

(12) United States Patent
Nakahara

(10) Patent No.: US 9,752,277 B2
(45) Date of Patent: Sep. 5, 2017

(54) CLOTH PIECE FOLDING DEVICE

(71) Applicant: PUREX Co., Ltd., Kagawa (JP)

(72) Inventor: Tetsuya Nakahara, Kagawa (JP)

(73) Assignee: PUREX CO., LTD., Kagawa (JP)

( * ) Notice: Subject to any disclaimer, the term of this patent is extended or adjusted under 35 U.S.C. 154(b) by 0 days.

(21) Appl. No.: 14/891,434

(22) PCT Filed: May 15, 2014

(86) PCT No.: PCT/JP2014/002560
§ 371 (c)(1),
(2) Date: Nov. 16, 2015

(87) PCT Pub. No.: WO2014/185077
PCT Pub. Date: Nov. 20, 2014

(65) Prior Publication Data

US 2016/0122939 A1 May 5, 2016

(30) Foreign Application Priority Data

May 17, 2013 (JP) ..... 2013-104695

(51) Int. Cl.
*D06F 89/00* (2006.01)
*D06F 61/00* (2006.01)
*D06F 69/00* (2006.01)

(52) U.S. Cl.
CPC ..... *D06F 89/00* (2013.01); *D06F 61/00* (2013.01); *D06F 69/00* (2013.01)

(58) Field of Classification Search
CPC ..... D06F 89/00–8/026; D06F 69/00; D06F 61/00
See application file for complete search history.

(56) References Cited

U.S. PATENT DOCUMENTS 2,804,298 A 8/1957 Buss
2,914,320 A * 11/1959 Petre ..... B65H 45/101 493/14

(Continued)

FOREIGN PATENT DOCUMENTS

EP 2327830 A1 6/2011
GB 715339 A 9/1954

(Continued)

OTHER PUBLICATIONS

European Patent Office, Extended European Search Report for EP Patent Application No. 14798031.2, Mar. 3, 2016.

(Continued)

*Primary Examiner* — Ismael Izaguirre

(57) ABSTRACT

A cloth piece folding device includes a conveyor (12) to transfer a cloth piece (Y), a bending unit (32) to fold the cloth piece (Y), and a controller (50) to control operation of the bending unit (32). The bending unit (32) includes a bending plate (32*a*) and an actuator (32*d*) to make the bending plate (32*a*) move forward and backward. The actuator (32*d*) is capable of controlling an operating speed. The controller (50) adjusts a driving speed of the bending plate (32*a*) by controlling an operating speed of the actuator (32*d*) depending on a transfer speed of the conveyor (12). The driving speed of the bending plate (32*a*) is adjusted by the controller (50). This synchronizes the transfer speed of the conveyor (12) and the driving speed of the bending plate (32*a*) with each other.

2 Claims, 9 Drawing Sheets

(56) References Cited

U.S. PATENT DOCUMENTS

| | | | | | |
|---|---|---|---|---|---|
| 2,954,974 | A | * | 10/1960 | Kellett | D06F 89/00 38/2 |
| 3,154,726 | A | | 10/1964 | McClain | |
| 3,589,709 | A | | 6/1971 | Hey | |
| 4,411,082 | A | * | 10/1983 | Ferrage | D06F 67/00 38/2 |
| 5,079,867 | A | * | 1/1992 | Kober | D06F 89/00 223/37 |
| 5,906,061 | A | * | 5/1999 | Adler | D06F 89/00 38/143 |
| 2011/0131844 | A1 | | 6/2011 | Kusunoki | |

FOREIGN PATENT DOCUMENTS

| | | | |
|---|---|---|---|
| JP | S53-144998 | U | 11/1978 |
| JP | S59-183455 | U | 12/1984 |
| JP | H05-000160 | Y2 | 1/1993 |
| JP | 2007-105067 | A | 4/2007 |
| JP | 3136400 | U | 10/2007 |
| JP | 2009-039443 | A | 2/2009 |
| JP | 2009-247604 | A | 10/2009 |
| JP | 2010-116237 | A | 5/2010 |

OTHER PUBLICATIONS

International Search Report for PCT/JP2014/002560, Aug. 19, 2014.

* cited by examiner (A)

(B)

(C)

(4)

(5)

(6)

CLOTH PIECE FOLDING DEVICE

TECHNICAL FIELD

This invention relates to a cloth piece folding device. In a laundry factory, for example, after being cleaned and ironed, cloth pieces such as bed sheets or towels are folded into a small size and a given number of such cloth pieces are piled up in stacks and shipped to hotels or hospitals. This invention relates to a cloth piece folding device to fold cloth pieces in this way.

BACKGROUND ART

A cloth piece folding device generally includes multiple conveyors to transfer a cloth piece, and a bending unit to fold the cloth piece being transferred by the conveyors at a given bending position. The bending unit is formed of a bending plate and an actuator to drive the bending plate. The actuator is configured to make the bending plate move forward and backward relative to a connection between two of the conveyors. The bending plate is driven when the bending position of the cloth piece reaches the connection between the conveyors. The bending position of the cloth piece is thrust into the connection between the conveyors and the cloth piece in a folded state is made to enter the connection between the conveyors, thereby folding the cloth piece.

The cloth piece folding device is generally used as a part of a linen facility installed in a laundry factory. As an example, the linen facility is formed of a charger, a roll ironer, and the cloth piece folding device. The input side of the roll ironer is connected to the output side of the charger. The input side of the cloth piece folding device is connected to the output side of the roll ironer. These components form a processing line. A cleaned cloth piece introduced into the charger is placed in a spread state with no loosening. Then, the cloth piece is ironed with the roll ironer and folded by the cloth piece folding device.

Ease of drying changes depending on the type of a cloth piece. Thus, a time for a cloth piece to pass through the roll ironer is adjusted depending on the type of the cloth piece. More specifically, a hard-to-dry cloth piece is set to be transferred at a low speed to take a long time to pass through the roll ironer, thereby drying this cloth piece completely. An easy-to-dry cloth piece is set to be transferred at a high speed to pass through the roll ironer in a short time, thereby enhancing processing efficiency. In this way, a speed of transfer of a cloth piece through the roll ironer is adjusted depending on the type of the cloth piece. A speed of transfer in the cloth piece folding device connected to the roll ironer is also adjusted accordingly in synchronization with the roll ironer.

A conventional cloth piece folding device uses an air cylinder as the actuator of the bending unit (see patent literature 1, for example). The air cylinder is hard to control in terms of an operating speed, so a driving speed of the bending plate is set at a constant speed irrespective of a change in a transfer speed of a conveyor. This makes a speed of a cloth piece being transferred by the conveyor and a driving speed of the bending plate asynchronous with each other, which makes it impossible to fold the cloth piece at the correct bending position, leading to poor folding accuracy.

PRIOR ART LITERATURE

Patent Literature

Patent Literature 1: Japanese Patent Application Publication No. 2007-105067

SUMMARY OF INVENTION

Problems to be Solved by Invention

In view of the aforementioned circumstances, this invention is intended to provide a cloth piece folding device capable of folding a cloth piece accurately through adjustment of a driving speed of a bending plate.

Means of Solving Problem

A cloth piece folding device according to a first invention includes a conveyor to transfer a cloth piece, a bending unit to fold the cloth piece, and a controller to control operation of the bending unit. The bending unit includes a bending plate and an actuator to make the bending plate move forward and backward. The actuator is capable of controlling an operating speed. The controller adjusts a driving speed of the bending plate by controlling an operating speed of the actuator depending on a transfer speed of the conveyor.

A cloth piece folding device according to a second invention is characterized in that in the cloth piece folding device according to the first invention, the controller controls the operating speed of the actuator so as to prevent a shift of a contact position between the bending plate and the cloth piece in a period from when the bending plate contacts the cloth piece to when an action completes.

Advantageous Effects of Invention

According to the first invention, the driving speed of the bending plate is adjusted by the controller. This synchronizes the transfer speed of the conveyor and the driving speed of the bending plate with each other. As a result, the cloth piece can be folded at a suitable bending position, so that the cloth piece can be folded accurately.

According to the second invention, a shift of the contact position between the bending plate and the cloth piece is prevented in a period from when the bending plate contacts the cloth piece to when an action completes. As a result, the cloth piece can be folded at a suitable bending position, so that the cloth piece can be folded accurately.

EMBODIMENT FOR CARRYING OUT INVENTION

Figure 1:
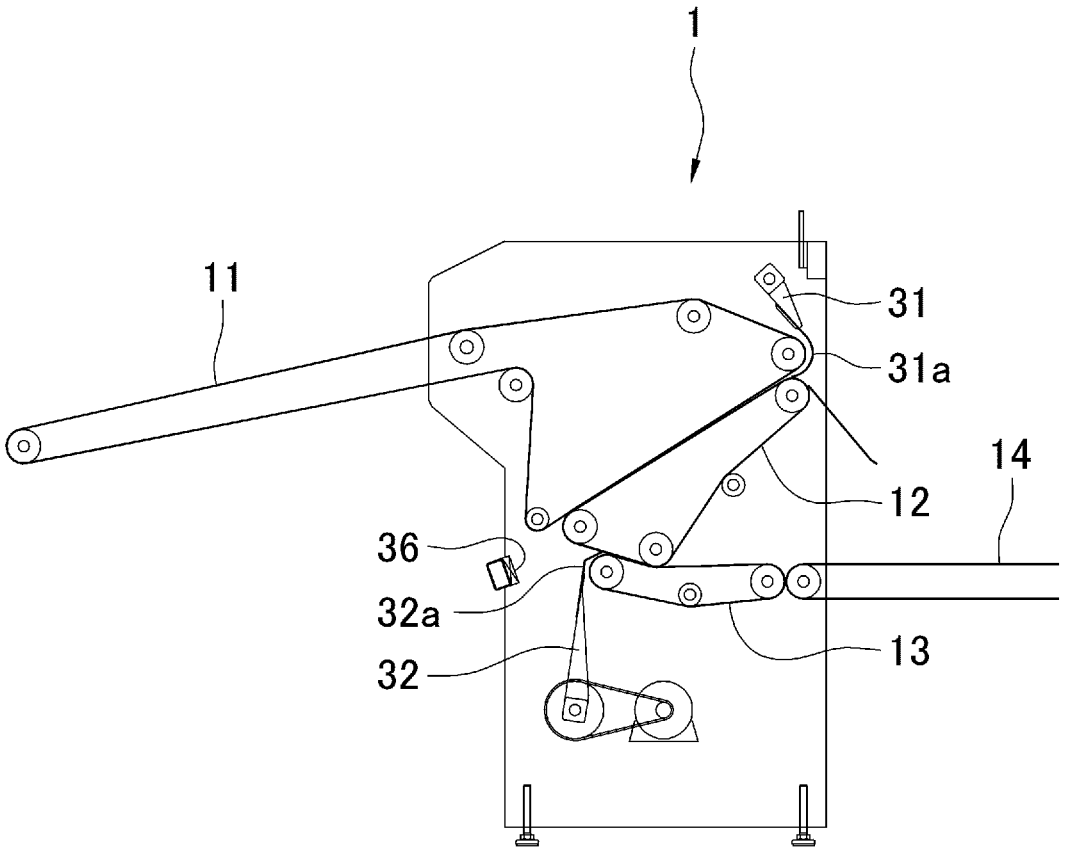
FIG. 1 is a side view of a former stage section of a cloth piece folding device according to an embodiment of this invention.

An embodiment of this invention is described below by referring to the drawings.

Figure 8:
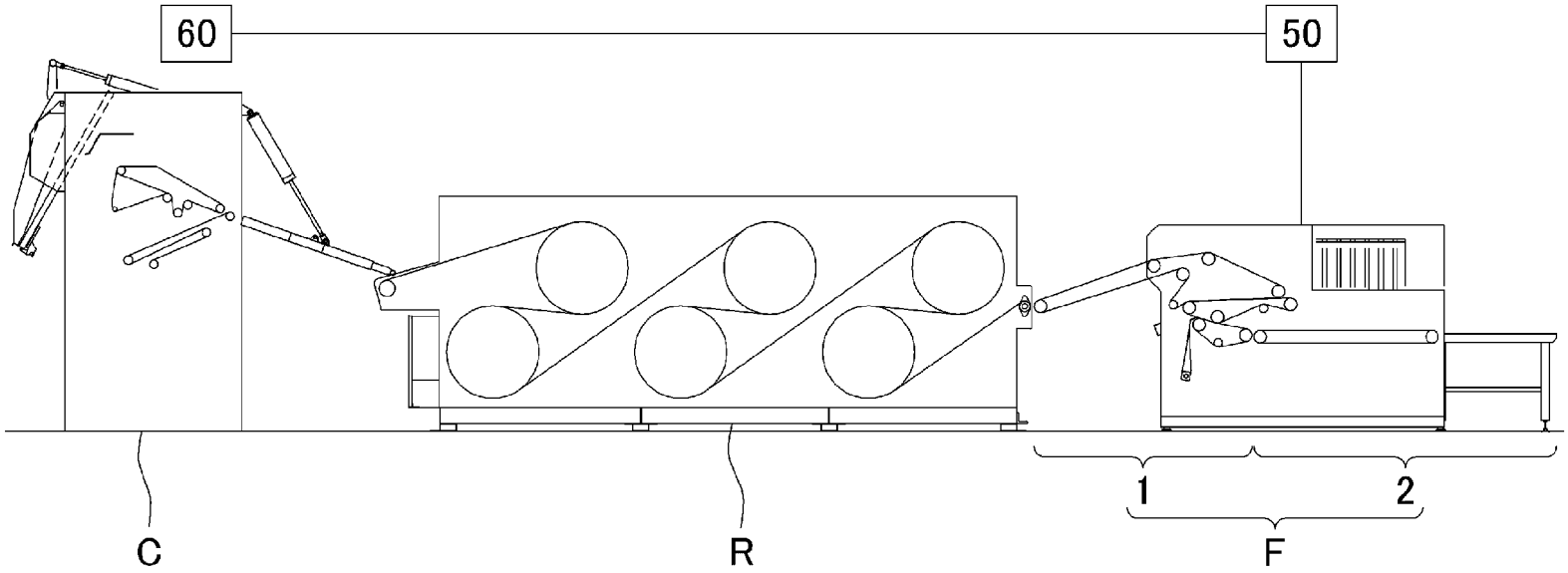
FIG. 8 explains a linen facility in its entirety.

A cloth piece folding device F according to the embodiment of this invention is used as a part of a linen facility such as that shown in FIG. 8. In the illustration of FIG. 8, the linen facility is formed of a charger C, a roll ironer R, and the cloth piece folding device F. The input side of the roll ironer R is connected to the output side of the charger C and the input side of the cloth piece folding device F is connected to the output side of the roll ironer R. These components form a processing line. A cleaned cloth piece introduced into the charger C is arranged in a spread state with no loosening. Then, the cloth piece is ironed with the roll ironer R and folded by the cloth piece folding device F.

Figure 9:
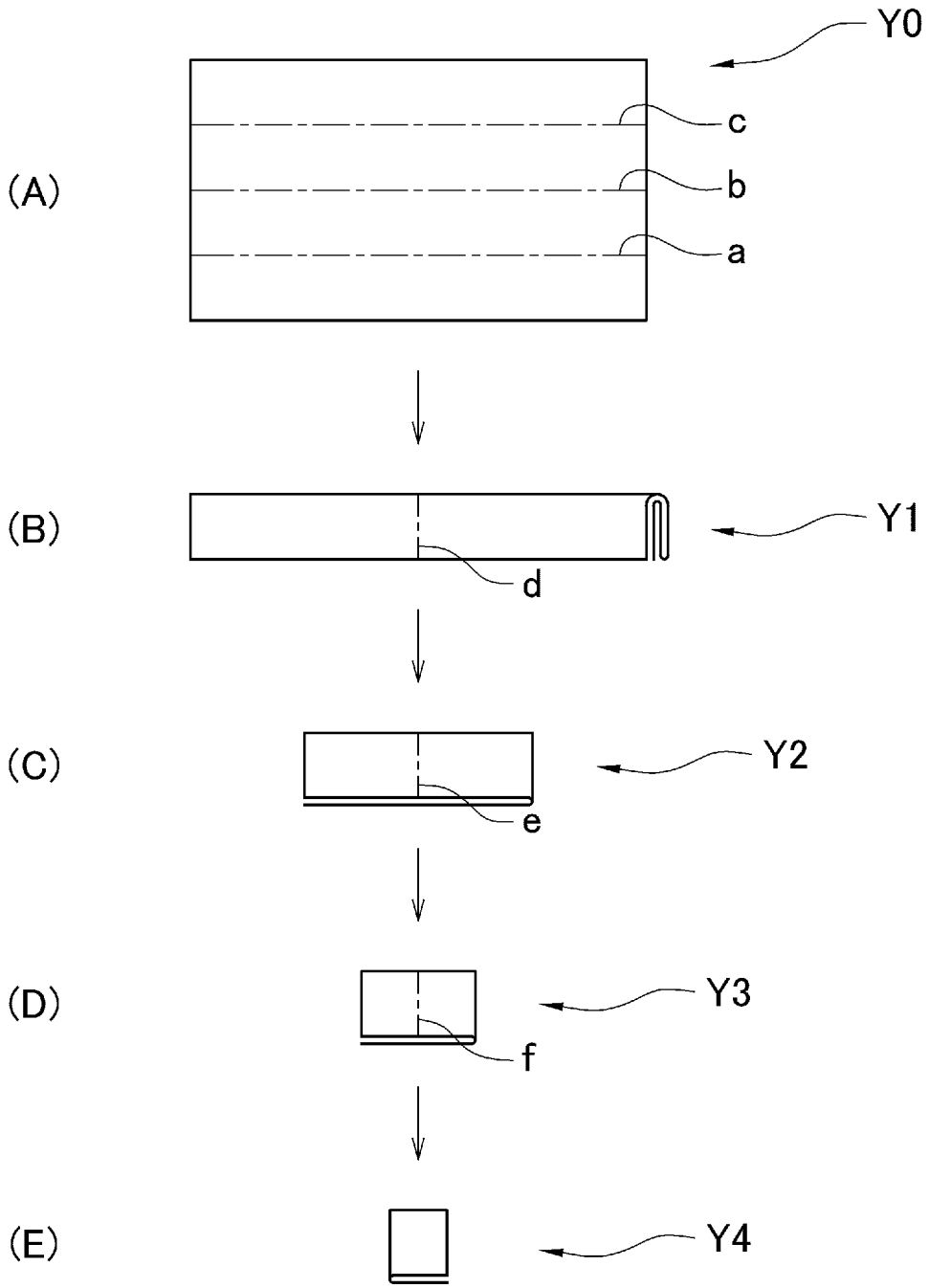
FIG. 9 explains a way of folding a cloth piece.

The cloth piece folding device F folds a cloth piece Y such as a bed sheet or a towel in a way shown in FIG. 9. (A) First, a cloth piece Y0 in a spread state is folded in four along three bending positions a, b, and c each parallel to the longitudinal direction of the cloth piece Y0. (B) Then, a cloth piece Y1 folded in four is folded in two along a bending position d at an intermediate position of the longitudinal direction of the cloth piece Y1 to be folded in eight. (C) A cloth piece Y2 folded in eight is folded in two along a bending position e at an intermediate position of the longitudinal direction of the cloth piece Y2 to be folded in 16. (D) A cloth piece Y3 folded in 16 is further folded in two along a bending position f at an intermediate position of the longitudinal direction of the cloth piece Y3 to be folded in 32. (E) As a result, a cloth piece Y4 folded in 32 is formed.

The cloth piece folding device F is formed of a former stage section 1 where the cloth piece Y0 in a spread state is folded in four, and a latter stage section 2 where the cloth piece Y1 folded in four is folded to form the cloth piece Y4 folded in 32 (see FIG. 8).

As shown in FIG. 1, the former stage section 1 includes three conveyors 11 to 13 to transfer the cloth piece Y. More specifically, the former stage section 1 includes a first conveyor 11 to receive the cloth piece Y0 in a spread state from the roll ironer R and feed the cloth piece Y0 to a subsequent stage; a second conveyor 12 provided so as to contact a lower transfer surface of the first conveyor 11; and a third conveyor 13 provided so as to contact a lower transfer surface of the second conveyor 12. The third conveyor 13 is connected to a fourth conveyor 14 in the latter stage section 2.

The former stage section 1 further includes a bending unit 31 and a bending unit 32 each prepared to fold the cloth piece Y at a connection of two of the aforementioned conveyors 11 to 13. More specifically, the former stage section 1 includes the first bending unit 31 provided near a connection between the end of the first conveyor 11 and the beginning of the second conveyor 12, and the second bending unit 32 provided near a connection between the end of the second conveyor 12 and the beginning of the third conveyor 13. The bending units 31 and 32 are formed of a bending plate 31*a* and a bending plate 32*a* respectively, and respective actuators to drive the bending plates 31*a* and 32*a*. A holding member 36 to catch the cloth piece Y0 in cooperation with the bending plate 32*a* of the second bending unit 32 is provided at a position facing the connection between the end of the second conveyor 12 and the beginning of the third conveyor 13.

Figure 2:
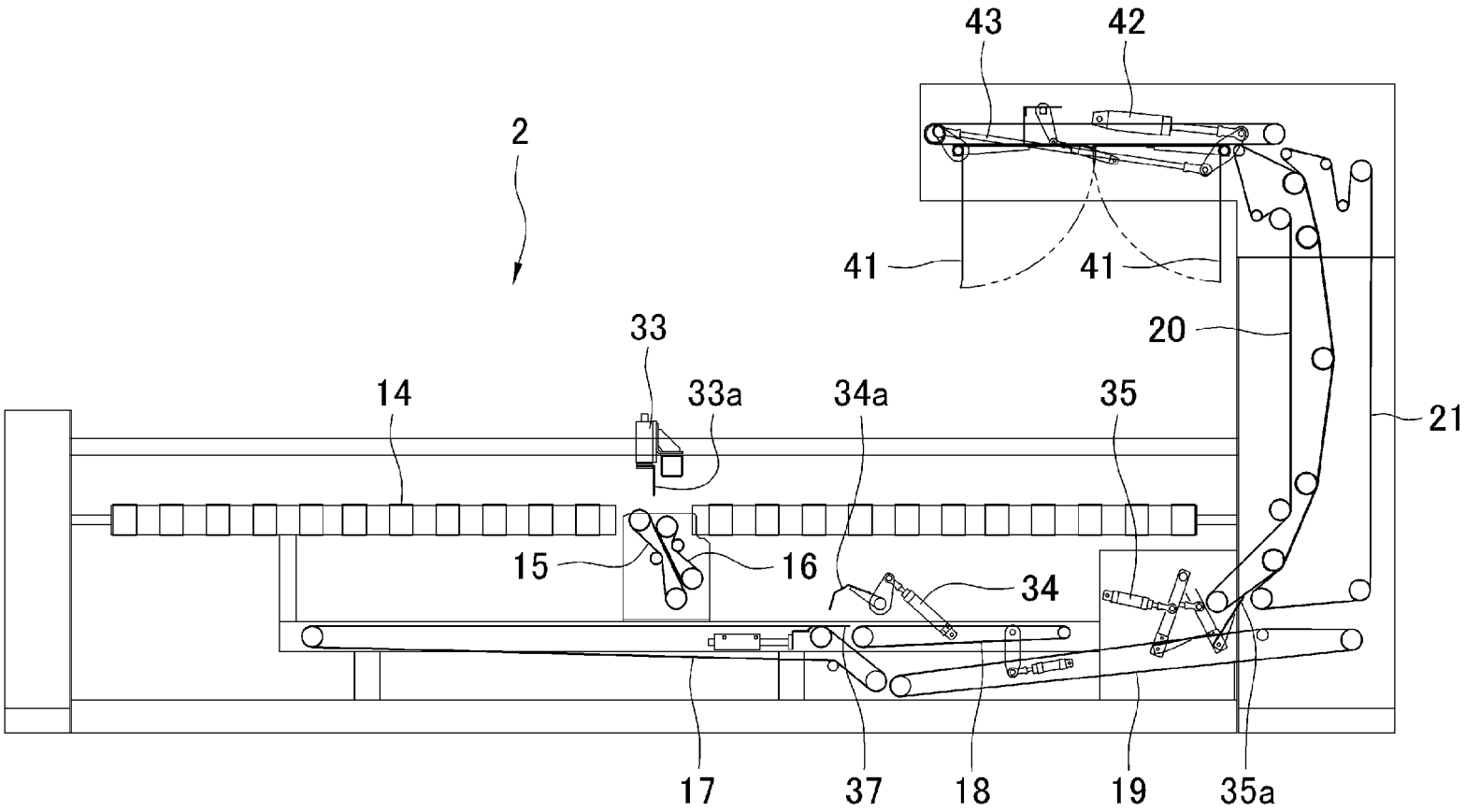
FIG. 2 is a front view of a latter stage section of the cloth piece folding device.

As shown in FIG. 2, the latter stage section 2 includes eight conveyors 14 to 21 to transfer the cloth piece Y. More specifically, the latter stage section 2 includes the fourth conveyor 14 connected to the third conveyor 13 in the former stage section 1, a fifth conveyor 15 and a sixth conveyor 16 provided below the center of the fourth conveyor 14 and having respective transfer surfaces facing each other, a seventh conveyor 17 and an eighth conveyor 18 provided below the fifth and sixth conveyors 15 and 16, a ninth conveyor 19 connected to the seventh conveyor 17 and provided below the eighth conveyor 18, and a tenth conveyor 20 and an eleventh conveyor 21 provided above the end of the ninth conveyor 19 and having respective transfer surfaces facing each other.

The latter stage section 2 further includes a bending unit 33, a bending unit 34, and a bending unit 35 each prepared to fold the cloth piece Y at a connection of two of the aforementioned conveyors 14 to 21. More specifically, the latter stage section 2 includes a third bending unit 33 provided near a connection between the beginning of the fifth conveyor 15 and the beginning of the sixth conveyor 16, a fourth bending unit 34 provided near a connection between the seventh 17 and eighth conveyors 18, and a fifth bending unit 35 provided near a connection between the beginning of the tenth conveyor 20 and the beginning of the eleventh conveyor 21. The bending units 33, 34, and 35 are formed of a bending plate 33*a*, 34*a*, and 35*a* respectively, and respective actuators to drive the bending plates 33*a*, 34*a*, and 35*a*.

A gap is formed at the connection between the seventh and eighth conveyors 17 and 18. A transit plate 37 is provided to open and close the gap. The transit plate 37 is made to move forward and backward by an actuator such as a servo actuator or an air cylinder and is configured to be able to open and close the gap at the connection between the seventh and eighth conveyors 17 and 18.

A pair of gate plates 41 and 41, an opening and closing unit 42 for opening and closing the gate plates 41 and 41, and a feed conveyor 43 to feed the folded cloth piece Y4 onto the gate plates 41 and 41 are provided at the respective ends of the tenth and eleventh conveyors 20 and 21.

The second bending unit 32 in the former stage section 1 is formed of the bending plate 32*a* and the actuator to drive the bending plate 32*a* and that is capable of controlling an operating speed. Examples of an actuator to be used as the "actuator capable of controlling an operating speed" include servo actuators such as a servo cylinder and a servo motor, and a stepping motor.

Figure 3:
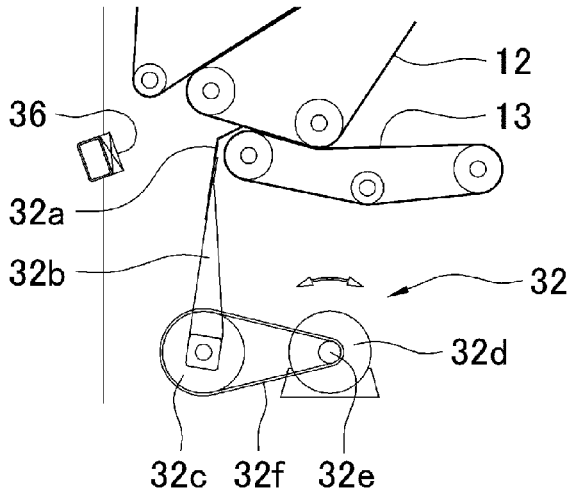
FIG. 3(A) explains a second bending unit of this embodiment, FIG. 3(B) explains a second bending unit of a different embodiment, and FIG. 3(C) explains a second bending unit of a still different embodiment.
Figure 3:
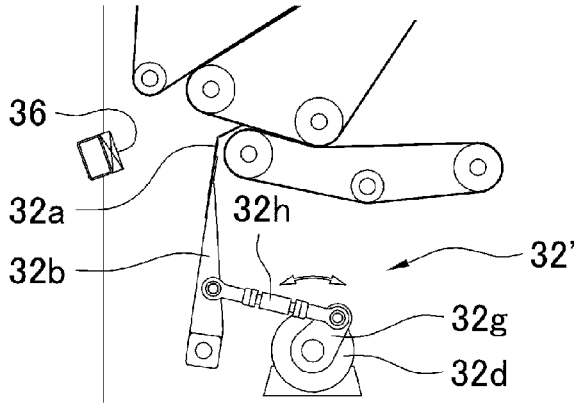
Figure 3:
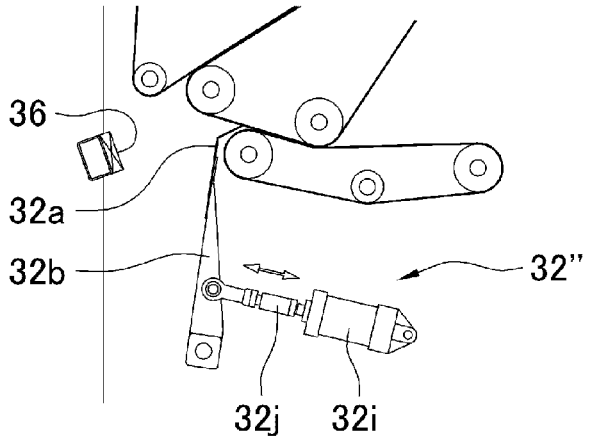

As shown in FIG. 3(A), in the second bending unit 32 of this embodiment, the bending plate 32*a* is fixed to the tip of an arm 32*b*. A base portion of the arm 32*b* is pivotally held to allow the bending plate 32*a* to make a swinging motion between the connection of the two conveyors 12 and 13 and the holding member 36. The base portion of the arm 32*b* is provided with a pulley 32*c*. The second bending unit 32 includes a servo motor 32*d*. A pulley 32*e* is fixed to the rotating shaft of the servo motor 32*d*. A timing belt 32*f* is stretched around the pulleys 32*c* and 32*e*. Thus, rotating the servo motor 32*d* forward and backward causes the swinging motion of the bending plate 32*a*, thereby allowing the bending plate 32*a* to move forward and backward relative to the connection between the two conveyors 12 and 13. The pulleys 32*c* and 32*e* may be replaced by sprockets. In this case, the timing belt 32*f* may be prepared as an endless roller chain.

According to a different embodiment, a second bending unit 32' shown in FIG. 3(B) includes the servo motor 32*d*. An arm 32*g* is fixed to the rotating shaft of the servo motor 32*d*. The tip of the arm 32*g* and an intermediate position of the arm 32*b* are coupled through a rod 32*h*. Thus, rotating the servo motor 32*d* forward and backward causes the swinging motion of the bending plate 32*a*, thereby allowing the bending plate 32*a* to move forward and backward relative to the connection between the two conveyors 12 and 13.

The servo motor 32*d* may be replaced by a different servo actuator. A second bending unit 32" shown in FIG. 3(C) shows an embodiment using a servo cylinder as a servo actuator. The second bending unit 32" includes a servo cylinder 32*i*. A piston rod 32*j* of the servo cylinder 32*i* is pin-connected to an intermediate position of the arm 32*b*. Thus, making the servo cylinder 32*i* expand and contract causes the swinging motion of the bending plate 32*a*, thereby allowing the bending plate 32*a* to move forward and backward relative to the connection between the two conveyors 12 and 13.

As described above, the second bending unit 32 is operated by the actuator 32*d* (32*i*) capable of controlling an operating speed. Thus, adjusting the operating speed of the actuator 32*d* (32*i*) can adjust a driving speed of the bending plate 32*a*. In particular, a servo actuator or a stepping motor is capable of controlling an operating speed easily. This facilitates control of a driving speed of a bending plate.

Each of the bending units 31 and 33 to 35 except the second bending unit 32 may also be configured so as to be driven by an actuator capable of controlling an operating speed.

As shown in FIG. 8, the cloth piece folding device F includes a controller 50. The controller 50 is formed of a CPU and a memory, for example. The controller 50 controls respective operations of the conveyors 11 to 21 and the bending units 31 to 35. The charger C includes a setting unit 60. The setting unit 60 is formed of a monitor and a user interface such as an operation button as well as a CPU and a memory. The setting unit 60 allows an operator to identify the type of the cloth piece Y introduced into the charger C. The setting unit 60 is connected not only to the charger C but also to the roll ironer R and the cloth piece folding device F. The setting unit 60 is configured such that it can change the operation of each component depending on the type of the cloth piece Y.

The roll ironer R is operated such that the cloth piece Y is transferred through the roll ironer R at a speed adjusted depending on the type of the cloth piece Y identified by the setting unit 60, thereby drying the introduced cloth piece Y completely.

The setting unit 60 is connected to the controller 50 of the cloth piece folding device F. Information indicating the type of the cloth piece Y identified by the setting unit 60 is input to the controller 50. The controller 50 stores a transfer speed of each of the conveyors 11 to 21 determined in advance for each type of the cloth piece Y. The controller 50 operates each of the conveyors 11 to 21 so as to achieve a transfer speed that corresponds to the type of the cloth piece Y input from the setting unit 60. As a result, a transfer speed in the cloth piece folding device F can be adjusted in synchronization with the roll ironer R.

The controller 50 controls an operating speed of the actuator 32*d* of the second bending unit 32 depending on a transfer speed of each of the conveyors 11 to 21, thereby adjusting a driving speed of the bending plate 32*a*. In this way, the transfer speed of each of the conveyors 11 to 21 and the driving speed of the bending plate 32*a* are synchronized with each other.

A method of folding the cloth piece Y implemented by the cloth piece folding device F is described next.

First, the cloth pieces Y0 in a spread state are fed one by one to the first conveyor 11 in the former stage section 1. Then, each cloth piece Y0 is folded by the second bending unit 32 to become the cloth piece Y1 folded in four while being transferred by the first to third conveyors 11 to 13. Then, the cloth piece Y1 is transferred to the fourth conveyor 14 in the latter stage section 2. A method of this folding implemented by the second bending unit 32 is described in detail later on.

Next, the cloth piece Y1 folded in four is folded by the third, fourth, and fifth bending units 33, 34, and 35 to become the cloth piece Y4 folded in 32 while being transferred by the fourth to eleventh conveyors 14 to 21 in the latter stage section 2.

Then, the cloth piece Y4 folded to a given size is then ejected through the gate plates 41 and 41. Such cloth pieces Y4 are piled up in stacks each including a given number of the cloth pieces Y4.

The following describes the method of folding the cloth pieces Y implemented by the second bending unit 32 in detail. The second bending unit 32 folds the cloth piece Y0 in four by the method roughly divided into two actions, a "holding action" and a "thrusting action."

Figure 4:
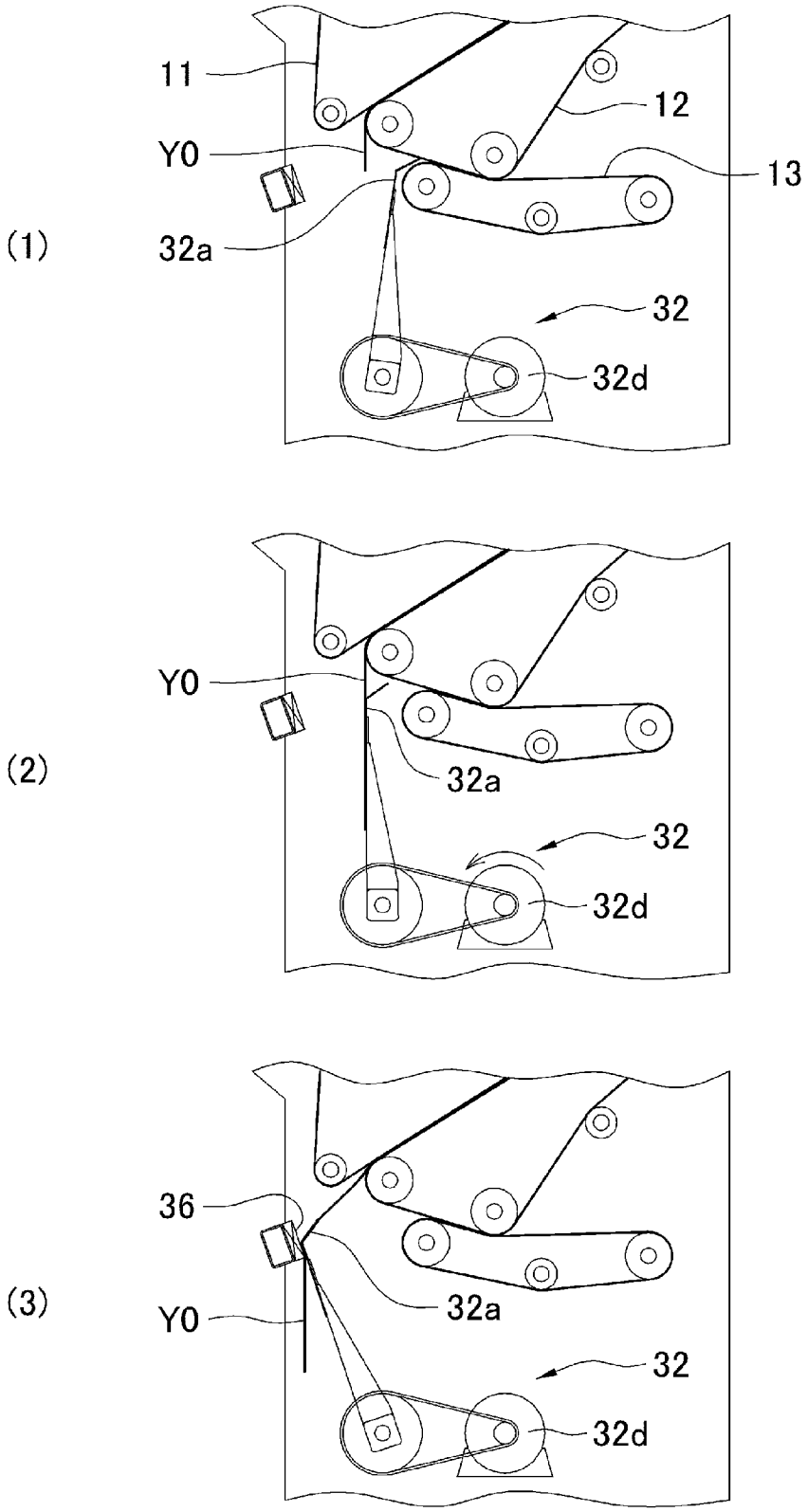
FIG. 4 explains operation of the second bending unit (steps (1), (2), and (3)).

As shown in FIG. 4, the "holding action" includes the following steps (1) to (3):

(1) The cloth piece Y0 having passed between the first and second conveyors 11 and 12 is ejected such that a front part of the cloth piece Y0 hangs down from the end of the second conveyor 12. At this time, the second bending unit 32 is placed in standby with the bending plate 32*a* thrust into the connection between the second and third conveyors 12 and 13. This makes the cloth piece Y0 hang down on the side of the rear surface (left side of FIG. 4) of the bending plate 32*a*.

(2) The bending plate 32*a* starts to be driven toward the holding member 36 at a given time. While the bending plate 32*a* is being driven, the rear surface of the bending plate 32*a* and the cloth piece Y0 contact each other.

(3) When the bending plate 32*a* is driven further to reach the holding member 36, the cloth piece Y0 is held with the bending plate 32*a* and the holding member 36 at a position at one quarter of distance from the front edge of the cloth piece Y0 (bending position a of FIG. 9(A)).

Figure 6:
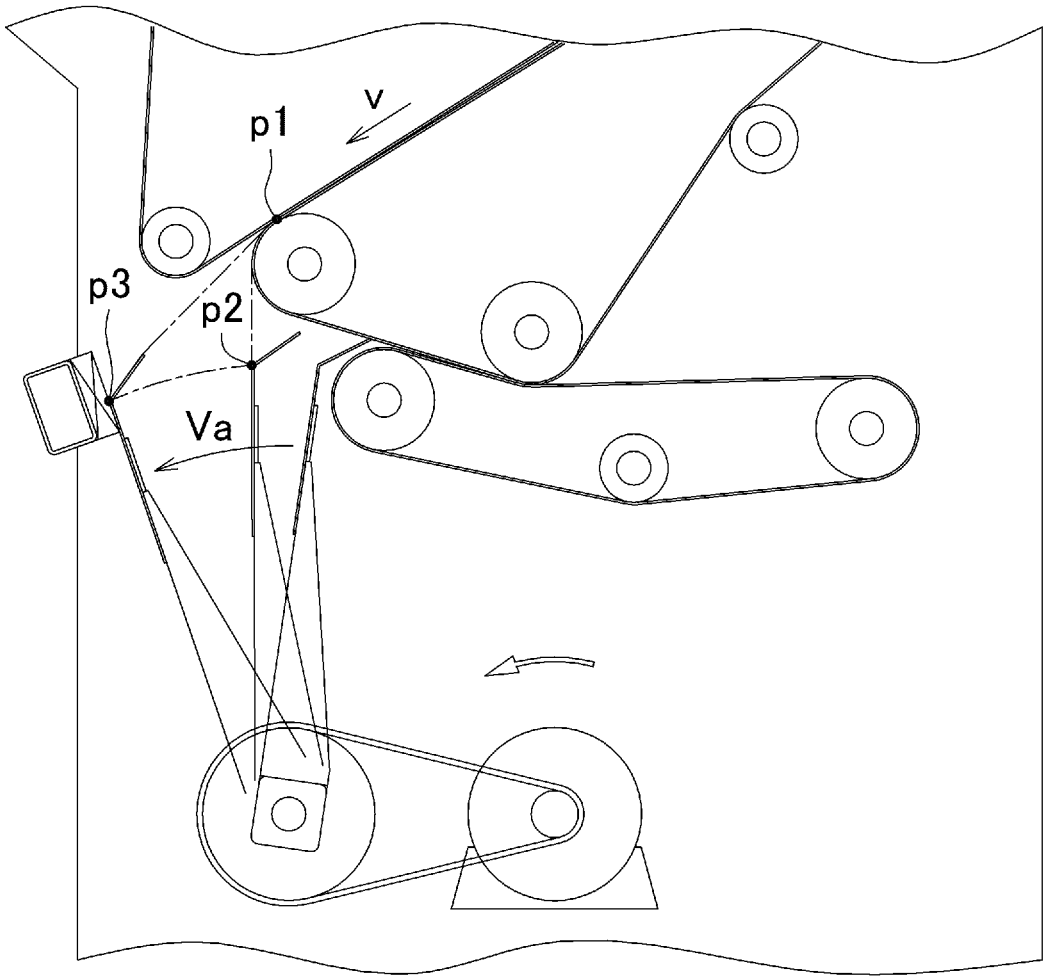
FIG. 6 explains a driving speed of a bending plate during a holding action.

The controller 50 controls an operating speed of the actuator 32*d* such that a contact position between the bending plate 32*a* and the cloth piece Y0 is not shifted in a period from when the bending plate 32*a* contacts the cloth piece Y0 to when the holding action completes. More specifically, as shown in FIG. 6, the position of an end roller of the second conveyor 12 is defined as p1, a contact position between the bending plate 32*a* and the cloth piece Y0 in the aforementioned step (2) is defined as p2, and a contact position between the bending plate 32*a* and the cloth piece Y0 in the aforementioned step (3) is defined as p3. A distance between the positions p1 and p2 is defined as $D_{12}$, a distance between the positions p1 and p3 is defined as $D_{13}$, and a distance between the positions p2 and p3 is defined as $D_{23}$. Further, a transfer speed of the second conveyor 12 is defined as v. A driving speed $V_a$ of the bending plate 32*a* on the line p2-p3 is adjusted based on the following formula 1. Making adjustment in this way drives the bending plate 32*a* in synchronization with a discharging speed of the cloth piece Y0, thereby preventing shift of the contact position between the bending plate 32*a* and the cloth piece Y0 during the holding action.

$$V_a = \frac{D_{23}}{D_{13} - D_{12}} v \quad \text{[Formula 1]}$$

Figure 5:
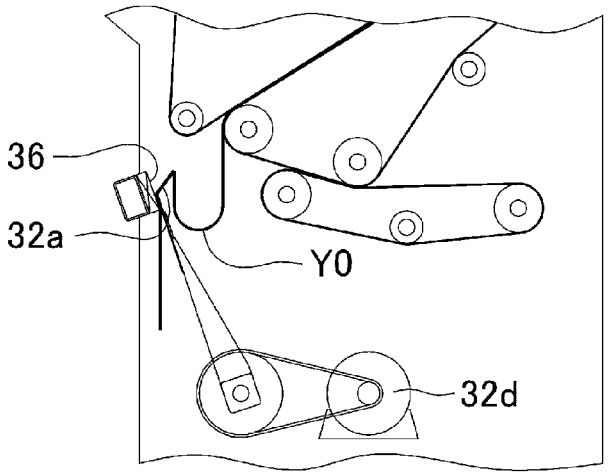
FIG. 5 explains operation of the second bending unit (steps (4), (5), and (6)).
Figure 5:
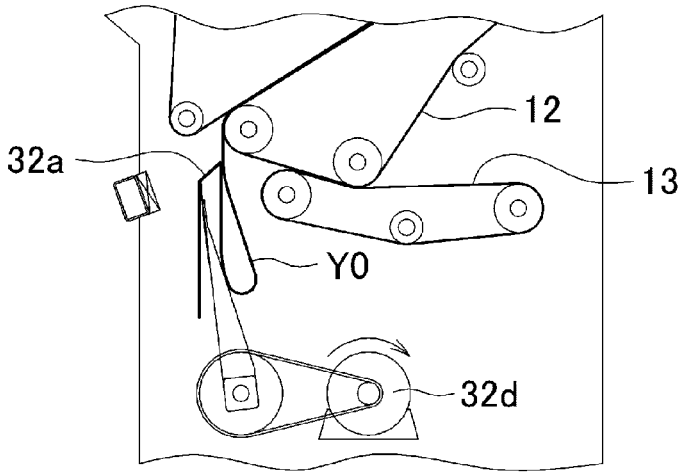
Figure 5:
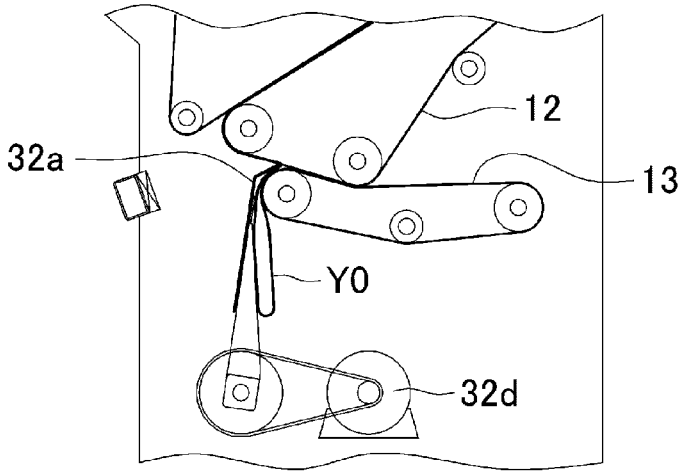

As shown in FIG. 5, the "thrusting action" includes the following steps (4) to (6):

(4) While being held with the bending plate 32*a* and the holding member 36, the cloth piece Y0 is ejected further. This makes an intermediate part of the cloth piece Y0 hang down in a U shape on the side of the front (right side of FIG. 5) of the bending plate 32*a*.

(5) The bending plate 32*a* starts to be driven toward the connection between the conveyors 12 and 13 at a given time. While the bending plate 32*a* is being driven, the tip of the bending plate 32*a* and the cloth piece Y0 contact each other.

(6) When bending plate 32*a* is driven further, the cloth piece Y0 is thrust into the connection between the conveyors 12 and 13 at a position at three quarters of a distance from the front edge of the cloth piece Y0 (bending position c of FIG. 9(A)). This folds the cloth piece Y0 in four to form the cloth piece Y1 folded in four.

Figure 7:
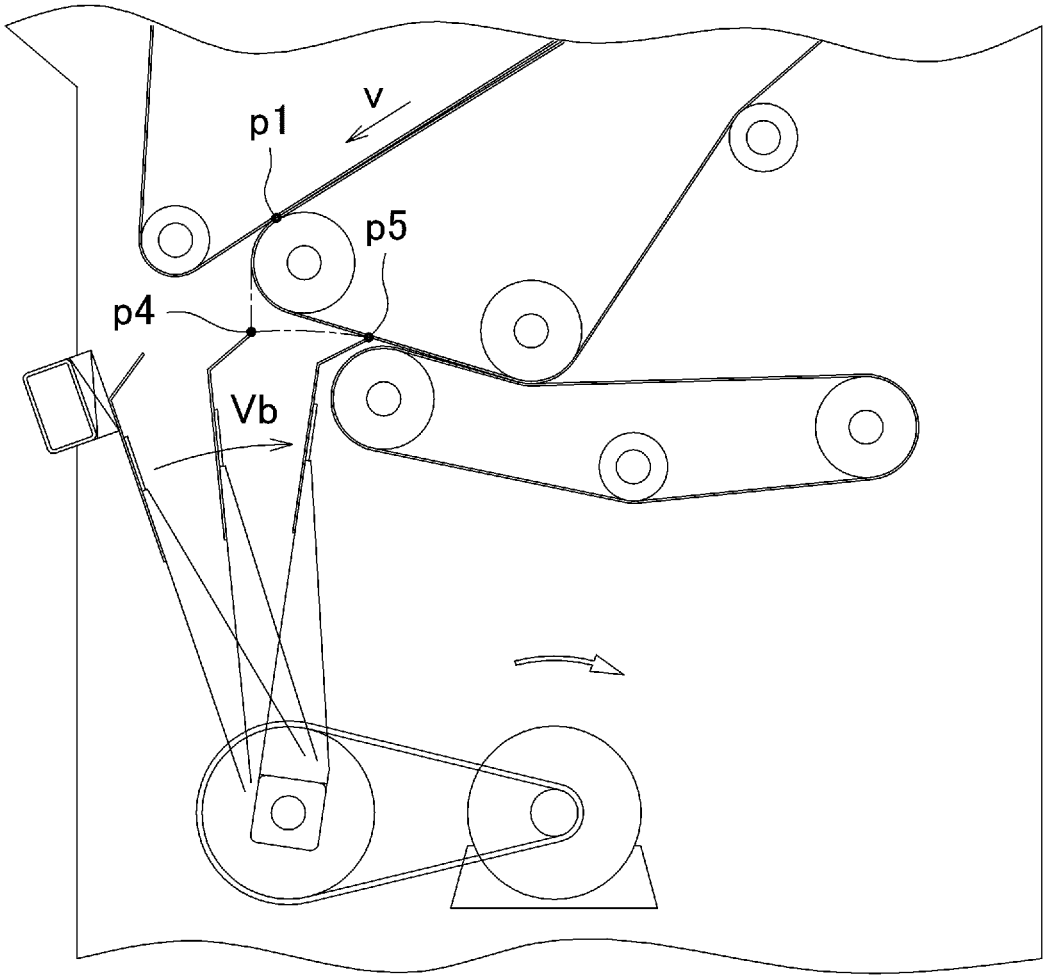
FIG. 7 explains a driving speed of the bending plate during a thrusting action.

The controller 50 controls an operating speed of the actuator 32*d* such that a contact position between the bending plate 32*a* and the cloth piece Y0 is not shifted in a period from when the bending plate 32*a* contacts the cloth piece Y0 to when the thrusting action completes. More specifically, as shown in FIG. 7, the position of the end roller of the second conveyor 12 is defined as p1, a contact position between the bending plate 32*a* and the cloth piece Y0 in the aforementioned step (5) is defined as p4, and a position where the bending plate 32*a* is thrust in the aforementioned step (6) is defined as p5. A distance between the positions p1 and p4 is defined as $D_{14}$, a distance between the positions p1 and p5 is defined as $D_{15}$, and a distance between the positions p4 and p5 is defined as $D_{45}$. Further, a transfer speed of the second conveyor 12 is defined as v. A driving speed $V_b$ of the bending plate 32*a* on the line p4-p5 is adjusted based on the following formula 2. Making adjustment in this way drives the bending plate 32*a* in synchronization with a discharging speed of the cloth piece Y0, thereby preventing shift of the contact position between the bending plate 32*a* and the cloth piece Y0 during the thrusting action.

$$V_b = \frac{D_{45}}{D_{15} - D_{14}} v \quad \text{[Formula 2]}$$

As described above, a driving speed of the bending plate 32*a* is adjusted by the controller 50. This synchronizes a transfer speed of a conveyor and the driving speed of the bending plate 32*a* with each other, thereby preventing a shift of a contact position between the bending plate 32*a* and the cloth piece Y in a period from when the bending plate 32*a* contacts the cloth piece Y to when an action completes. As a result, the cloth piece Y can be folded at a suitable bending position, so that the cloth piece Y can be folded accurately.

REFERENCE SIGNS LIST

F Cloth piece folding device
1 Former stage section
2 Latter stage section
11 to 21 Conveyor
31 to 35 Bending unit
31*a* to 35*a* Bending plate
32*b* Arm
32*c* Pulley
32*d* Servo motor
32*e* Pulley
32*f* Timing belt
32*g* Arm
32*h* Rod
32*i* Servo cylinder
32*j* Piston rod
36 Holding member
37 Transit plate
50 Controller
60 Setting unit

The invention claimed is:

1. A cloth piece folding device comprising:
a conveyor to transfer a cloth piece;
a bending unit to fold the cloth piece; and
a controller to control operation of the bending unit,
wherein the bending unit comprises:
a bending plate; and
an actuator to make the bending plate move forward and backward, the actuator being capable of controlling an operating speed, and
the controller adjusts a driving speed of the bending plate by controlling an operating speed of the actuator depending on a transfer speed of the conveyor.

2. The cloth piece folding device according to claim 1, wherein the controller controls the operating speed of the actuator so as to prevent a shift of a contact position between the bending plate and the cloth piece in a period from when the bending plate contacts the cloth piece to when an action completes.

* * * * *